United States Patent [19]

Otto et al.

[11] 4,271,220

[45] Jun. 2, 1981

[54] LAMINATED STRUCTURE INCORPORATING EXPANDABLE POCKETS

[75] Inventors: Michael J. Otto, Kalamazoo; George C. Ray, Battle Creek, both of Mich.

[73] Assignee: General Foods Corporation, White Plains, N.Y.

[21] Appl. No.: 74,196

[22] Filed: Sep. 10, 1979

[51] Int. Cl.[3] ..... B32B 3/10; B32B 7/06; B32B 7/12

[52] U.S. Cl. ..... 428/134; 40/124.2; 40/124.4; 40/159; 428/138

[58] Field of Search ..... 428/35, 131, 132, 134, 428/135, 136, 137, 138, 155, 194; 40/124.2, 124.4, 159; 229/69, 72

[56] References Cited

U.S. PATENT DOCUMENTS

| | | | |
|---|---|---|---|
| 2,792,228 | 5/1957 | Chaikin | 40/124.4 |
| 2,886,907 | 5/1959 | Stephenson | 40/124.2 |
| 2,942,723 | 6/1960 | Shapery et al. | 40/124.2 |

*Primary Examiner*—William J. Van Balen
*Attorney, Agent, or Firm*—C. Garman Hubbard; Thomas V. Sullivan; Bruno P. Struzzi

[57] ABSTRACT

A laminated or multiple-ply structure comprising an inner wall of a substantially rigid material and an outer wall of a thin generally pliant material, such as a glossy finished paper, adhesively fastened thereto by a suitable adhesive or glue. A plurality of artifact receiving pockets are formed in the thin outer wall of the container, with each pocket being formed through the intermediary of a suitable perforation configuration formed therein. Each perforation configuration includes slits penetrating through the outer wall material and defining a pocket by a plurality of discontinuous slits extending along the semicircular peripheral edge of the pocket. The laminating adhesive is interposed between the inner and outer walls to form the laminated structure with an adhesive repellent medium being provided intermediate the inner and outer walls in areas substantially coextensive with the areas of the pockets such that each pocket is expandable away from the inner wall to facilitate the insertion therein of a medallion or other suitable artifact. The teachings herein have particular applicability to a packaging arrangement for consumer products such as a laminated box for breakfast cereals.

15 Claims, 7 Drawing Figures

LAMINATED STRUCTURE INCORPORATING EXPANDABLE POCKETS

BACKGROUND OF THE INVENTION

1. Field of the Invention

The present invention relates generally to a laminated structure and, more particularly, pertains to a laminated container structure having expandable pockets formed therein suitable for the insertion of medallions or other suitable artifacts.

Commodities such as cereals, crackers, cookies, etc. are often merchandised in packaging media designed in one manner or another to promote the sale of the commodity. Recently, containers or packages have been developed which incorporate easily detachable or peelable coupons or decals as integral elements on the outer wall or ply of a laminated container structure, with such elements being readily adaptable for use as promotional items or premiums. Known merchandising plans include the formation of a peelable coupon, redeemable towards the purchase of the goods, on the outer container wall in a manner to facilitate removal thereof, and the inclusion on the outer container wall of a removable or peelable panel having imprinted thereon a heat-transferrable image which, after separation of the panel from the container structure, is adapted to be positioned in contact with a suitable transfer surface. The transferable image, commonly referred to as an "iron on" patch, is imparted to the transfer surface through the application of heat from a hot iron to form a decorative image or imprint thereon.

However, none of the above-mentioned promotional plans disclose or suggest incorporating, as a promotional feature on the outside of a laminated container, an integral component in the outer wall thereof which is expandable relative to the remaining structure to form a pocket suitable for the insertion therein of a medallion or other suitable collectible.

2. Discussion of the Prior Art

U.S. patent application Ser. No. 836,873 for *Laminated Container Structure Incorporating A Peelable Coupon,* filed Sept. 26, 1977 discloses therein a laminated container structure in which a peelable coupon forms an integral portion of the outer container wall and is defined by a perforated tear outline. In a first embodiment, a release agent is coated below the coupon area to prevent adherence of the coupon to the adhesive fastening together the outer and inner walls of the container. In a second embodiment, the inner wall is formed of cylinderboard adhesively fastened to the outer wall with the perforate coupon tear outline extending through the outer wall, adhesive and outermost ply of the inner wall, so that peeling of the coupon will not remove the inner plies of the inner wall and not destroy the integrity of the container. However, neither of the embodiments disclosed therein is suitable for the construction of a laminated structure incorporating pockets which are expandable away from an inner wall to facilitate the insertion therein of a medallion or other suitable artifact.

U.S. patent application Ser. No. 002,701 for *Laminated Container Structure Incorporating A Peelable Panel Section Having A Heat Transferable Image,* filed Jan. 10, 1979 discloses a laminated or multiple-ply container structure comprising an inner wall of a substantially rigid material and an outer wall of a thin, generally pliant material, such as a glossy finished paper, adhesively fastened thereto by a suitable adhesive or glue. A removable or peelable coupon-like panel is formed in the outer wall of the container as an integral component thereof, and is separable therefrom through the intermediary of a tear outline constituted of perforations extending through at least the outer ply or wall. The panel is adapted to be peeled off the container without adversely affecting the integrity of the container structure or necessitating the use of special cutting instruments or tools. The outer surface of the removable panel has a heat transferable image imprinted thereon which, after separation of the panel from the remaining structure, is adapted to be positioned in contact with a suitable transfer surface whereby, through the application of a hot iron, the transferable image which is also commonly referred to as an "iron-on" is imparted to the transfer surface to form a decorative image or imprint thereon. The laminated structure disclosed herein is also not suitable for the construction of a laminated structure incorporating expandable pockets of the type disclosed and claimed herein.

SUMMARY OF THE INVENTION

Accordingly, the present invention contemplates the provision of a laminated or multiple ply container structure comprising an inner wall constituted of a substantially rigid material and an outer wall formed of a relatively thin generally pliant material adapted to have indicia imprinted thereon, and at least one perforation configuration provided therein to form at least one pocket to facilitate the insertion of a suitable object. Each pocket is formed by a perforation configuration comprising slits arranged in a pattern defining at least one object receiving pocket intermediate the inner and outer walls, with a laminating adhesive interposed between the walls for joinder thereof in all areas except those substantially coextensive with the areas of the pockets. In accordance with the disclosed invention, adherence of the inner and outer walls to each other in areas substantially coextensive with the areas of each pocket is prevented by providing an adhesive repellent medium intermediate the inner and outer walls in those areas. Furthermore, each performation configuration is positioned along the peripheral edge of the defined pocket, and the slits in the pattern are positioned relative to each other a distance sufficient to form a pocket which accepts the thickness of the inserted object and overlaps a given distance in a predetermined pattern. In a first disclosed embodiment, the configuration also includes a continuous slit defining a tear line extending between opposite portions of the semicircular pocket and affording access into the pocket for the deposit therein of a suitable collectible object, a first plurality of discontinuous slits extending along the semicircular peripheral edge of the pocket from opposite ends of the continuous slit and functioning to relieve stresses induced in the outer ply as an object is inserted into the pocket, and a second plurality of discontinuous slits extending transversely across the pocket intermediate opposite ends of the continuous slit and defining, in combination with the first continuous slit, a fold or tearline to provide a lift tab which may be grasped to open the initial edge of the pocket. In further detail, the first plurality of discontinuous slits extending along the semicircular peripheral edge of the pocket are linear slits extending between radially inner and outer circles and are located at increased spacings from each other proceeding from opposite ends of the continuous slit towards the bottom portion of the pocket. In one disclosed embodiment the continuous slit is formed by a plurality of tangentially joined, alternately concavely and convexly curved arcuate segments. The pliant material forming the outer wall is yieldably deformable to facilitate the insertion of an object into the pocket, with the first plurality of discontinuous slits along the semicircular peripheral edge relieving stresses generated in the pliant material upon insertion of an object into the pocket to avoid rupturing either the outer or inner walls of the laminated packaging structure. The particular object adapted to be received by each pocket may be a disc-like medal or medallion. In further detail, the continuous slit extends along the upper portion of the pocket, and the first plurality of discontinuous slits extends along the lower portion thereof. Also, the portion of the pocket defined by the first continuous slit and the second plurality of transversely extending discontinuous slits forms a gripping tab for opening of the pocket to facilitate the insertion therein of an object such as a medallion. Furthermore, the particular laminated structure is adapted to be formed into a container having front, rear and side wall panels with closure wall sections at the ends thereof, and a plurality of pockets are arranged in a predetermined array in the outer wall material of one of the container wall panels. With a container of this nature, the inner wall is generally constituted of a generally rigid paperboard, and the outer wall has a glossy finish thereon suitable for the printing thereon of suitable indicia. In this arrangement the adhesive repellent medium is located on the surface of the outer wall material facing the laminating adhesive.

Furthermore, the teachings of the present invention may be incorporated into laminated packaging materials for promotional displays or can be specifically designed for applications as coin savers, coin collections or receptacles for other types of small objects.

Accordingly it is a primary object of the present invention to provide a laminated packaging structure incorporating pockets which are expandable away from an inner wall to facilitate the insertion therein of a medallion or other suitable artifact without requiring the use of an interply spacer.

Another object of the present invention is to provide a novel laminated container structure in which the pockets provided therein are expandable in a manner which allows the outer ply to deform from the plane of the structure without adversely affect the integrity of the container after an artifact is placed in a pocket.

A more specific object of the present invention is the provision of a laminated container structure of the type described wherein each pocket is formed by a perforated tearout line comprising a plurality of discontinuous slits extending around the circumference of the pocket.

Further and more specific objects of the present invention are the provision of a novel laminated structure which: consists of a relatively flexible material such as paper bound to a relatively stiff backing substrate such as paperboard; has a pattern applied interply adhesive repellent that prevents bonding of two plies in an area of pocket formation during the lamination process; has a perforation configuration which relieves the stresses induced in the outer ply as an object is inserted between the plies and which allows the outer ply to deform from the plane of the package and form a pocket; allows coin pockets to be incorporated into laminated packaging structures during conventional package manufacturing operations without special materials or processes; allows relatively thick objects to be inserted between the plies of the lamination without rupturing either of the layers; has the ability to incorporate coin pockets into a laminated packaging structure during a conventional package manufacturing process without special equipment or materials; has the ability to size the pocket to suit the dimensions of a variety of insertable objects; initially results in pocket being coplanar with the surface of the package and thus does not interfere with subsequent packaging or machine operations; forms the pocket from two plies rather than three and accordingly is more economical; results in a package or display board which may be cut from the web with a conventional platen press and wherein the outer ply is perforated to form the pockets simultaneous to the formation of the carton blank; has pocket perforations defining the lift tab opening characteristics of the pocket and the configuration of the pocket, and wherein the outerply separates from the inner ply by a distance to accommodate the thickness of an inserted object; has a lift tab in the form of a protuberance that can be raised and grasped with the fingers to open the initial edge of the pocket, and wherein a transverse perforation defines the lower edge of the lift tab, at which the tab can be folded or detached to better display the object once inserted; has perforations defining the configuration and opening characteristics of the pocket and consisting of short, overlapped cuts about the perimeter of the object except for the bottom, a line connecting the innermost ends of the cuts to define the pocket size and configuration, whether it be round as for a single coin or rectangular for a series of coins as for a coin saver and wherein the distance between the outermost end of a cut and the innermost end of an adjacent cut, measured in the direction of insertion, is the distance the outer ply will expand from the plane of the package as the object is inserted therein; forms a pocket wherein, as an object is inserted beneath the outer ply, stresses are induced which cause the outer ply to first, raise from its initial position and then, fold in the area of the perforations, with the folds originating at both ends of a cut; forms a pocket wherein the outer ply is displaced a distance equal to the distance between the folds, and further wherein the pockets can be sized for a variety of objects simply by repositioning the side cuts to conform to the object's thickness and shape; has a design allowing a coin display board to be created from a simple two ply lamination; and allows a coin display to be incorporated into a packaging medium for promotional use while avoiding the necessity of a third ply spacer that is normally required to create the cavity for a coin.

BRIEF DESCRIPTION OF THE DRAWINGS

The foregoing and other objects and advantages of a laminated packaging structure constructed pursuant to the teachings of the present invention may be more readily understood by one skilled in the art, having reference to the following detailed description of a preferred embodiment thereof taken in conjunction with the accompanying drawings in which identical reference numeral are used to refer to like elements throughout the several views, and in which.

DETAILED DESCRIPTION OF THE DRAWINGS

Figure 1:
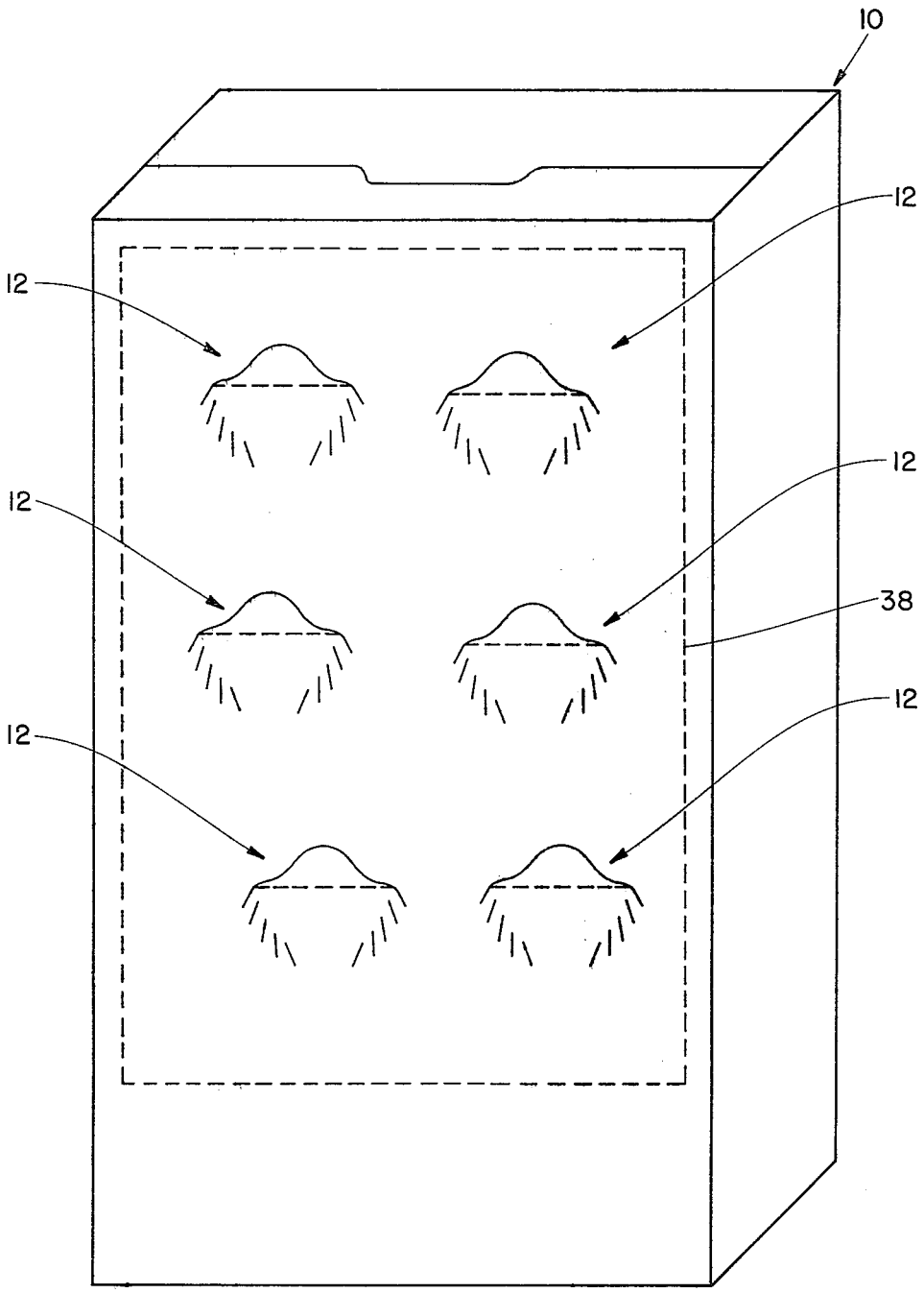
FIG. 1 is a rearward perspective view of a packaging carton constructed with the laminating structure of the present invention, and illustrates an array of expandable pockets formed therein prior to expansion thereof.
Figure 2:
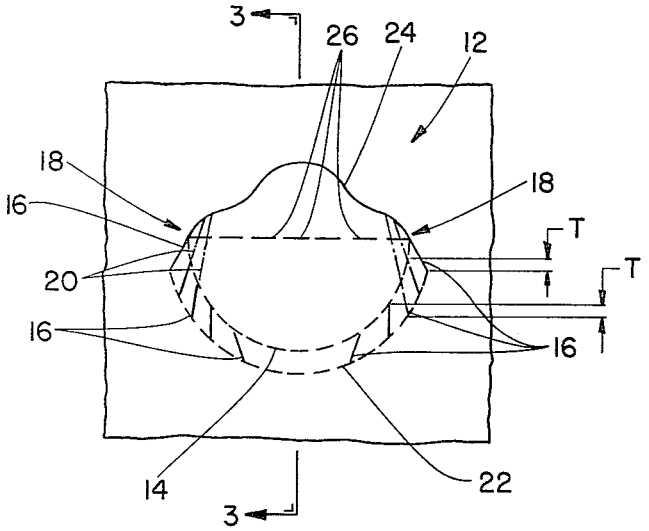
FIG. 2 is an enlarged frontal view of the tear-out-line forming one pocket prior to expansion thereof.

Referring now in detail to the drawings, FIG. 1 illustrates a rearward perspective view of a laminated packaging container 10 in the form of a box or carton constructed pursuant to the teachings of the present invention and having thereon an array of expandable pockets 12, with the figure illustrating the pockets prior to expansion thereof. The container has front, rear and side wall panels, with closure sections being provided at the top and bottom thereof. The pockets are constructed in the outer wall material of the laminated structure forming the carton, and in the disclosed embodiment are formed in the rear wall panel, with the other panels having suitable trademark advertising and product identification and information indicia printed thereon. Referring with particularity to FIGS. 1 and 2, each pocket is formed by a perforation configuration cut in the outer wall ply of the laminated structure with the pocket thus formed facilitating the insertion therein of a suitable collectible object such as a medallion. The perforation configuration defines a pocket formed along a semicircular peripheral segment 14 by a first plurality of discontinuous slits 16 extending from opposite side portions 18 of the pocket downwardly toward the bottom thereof. Each of the first plurality of discontinuous slits 16 is a linear slit which extends between semicircular peripheral segment 14 and a concentric radially outer circle 22. As indicated in FIG. 2, the opposite ends of adjacent slits along each edge are separated by a distance T, as measured by the indicated parallel lines, to define the maximum thickness T of an object the pocket will accommodate. The linear slits 16 are located at increased spacings from each other proceeding from the opposite sides 18 towards the bottom portion of the pocket. A continuous slit 24 defines the top of the pocket, and is formed by a plurality of tangentially joined, alternately concavely and convexly curved arcuate segments extending between the side portions of the pocket whereat they join the uppermost linear slit 18 on each side of the pocket. The perforation configuration is further defined by a second plurality of discontinuous linear slits 26 extending transversely and linearly across the pocket intermediate the opposite sides 18 thereof.

In this overall arrangement, the first plurality of slit 16 relieve the stresses induced in the outer ply as an object is inserted in the pocket by allowing the outer ply to deform from the plane of the package to form a pocket. The slits 16 define the configuration and opening characteristic of the pocket, and in particular the distance between the outermost end of one slit and the innermost end of an adjacent slit, measured in the direction of insertion, is the distance the outer ply will expand from the plane of the package as the object is inserted therein. The insertion of an object into the pocket induces stresses in the outer ply to cause it to first raise from its initial position, and then fold in the area of the perforations, with the folds originating at both ends of each slit 16 thereby forming a pocket wherein the outer ply is displaced a distance equal to the distance between the folds. In the opened position of the pocket, a line connecting the innermost ends of the slits 16 defines the final size and configuration thereof. The continuous slit 24 defines a tear line extending across the top of the pocket and affords access to the pocket for the deposit therein of a suitable collectible object. Further, the continuous slit 24 combines with the second plurality of discontinuous slits 26 extending transversely across the pocket to provide a lift tab which may be grasped to open the initial edge of the pocket, with the gripping tab being illustrated in a downwardly folded position in FIGS. 5 and 6.

The laminated packaging structure includes an inner wall 28 constituted of a substantially rigid material such as a generally rigid paperboard and an outer wall 30 formed of a relatively thin, generally pliant material having a glossy coating thereon suitable for the printing of indicia of various colors. The inner and outer walls of the laminated structure are adhesively fastened together by a suitable layer of adhesive or glue 32 placed therebetween, and adherence of the laminated layers to each other in areas substantially coextensive with the areas of each pocket is prevented by providing an adhesive repellent medium 34 intermediate the inner and outer walls in those areas. In the disclosed embodiment, the adhesive repellent medium is selectively applied in a pattern to the surface of the outer wall material facing the laminating adhesive. In other embodiments, adherence of the inner and outer walls in areas substantially coextensive with the areas of each pocket may be prevented by the selective application of a laminating adhesive in all areas except those substantially coextensive with areas of the pockets.

Figure 3:
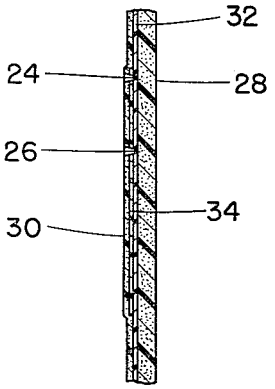
FIG. 3 is a cross-sectional view taken along line 3—3 in FIG. 2, and illustrates details of the laminated structure.
Figure 6:
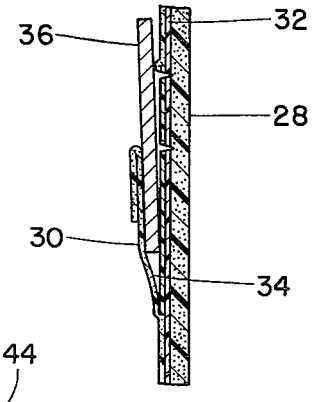
FIG. 6 is a sectional view of FIG. 5 taken along line 6—6, and illustrates the position of a medallion or artifact in relationship to the laminated structure forming the pocket after expansion thereof and placement therein of the medallion.

The inventive laminated structure disclosed herein allows expandable pockets to be incorporated into two ply laminated packaging structures produced by conventional package manufacturing operations without requiring special equipment or materials. The perforation pattern in the outer ply may be cut therein simultaneously with the formation of the carton blank. The resultant two-ply laminated structure may be severed from a web by a conventional platen press. Further, the pockets thusly produced are initially coplanar with the surface of the package, and do not interfere with subsequent packaging and machine operations. In this regard, it should be mentioned that the layers of adhesive and adhesive repellent medium shown in the laminated structure of FIGS. 3 and 6 are exaggerated to illustrate their presence, and would not actually cause the outer layer 30 to bow significantly outwardly as illustrated in those drawings.

Figure 5:
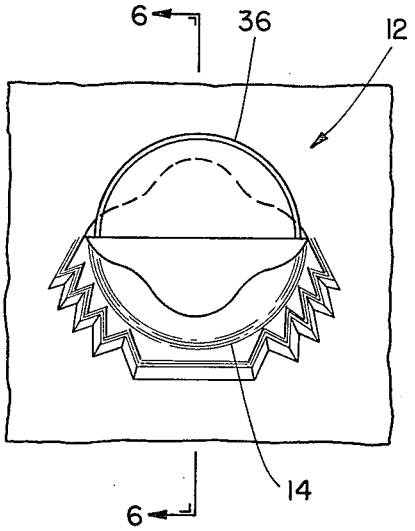
FIG. 5 is an enlarged frontal view of one pocket after its expansion and the insertion therein of a suitable artifact.
Figure 4:
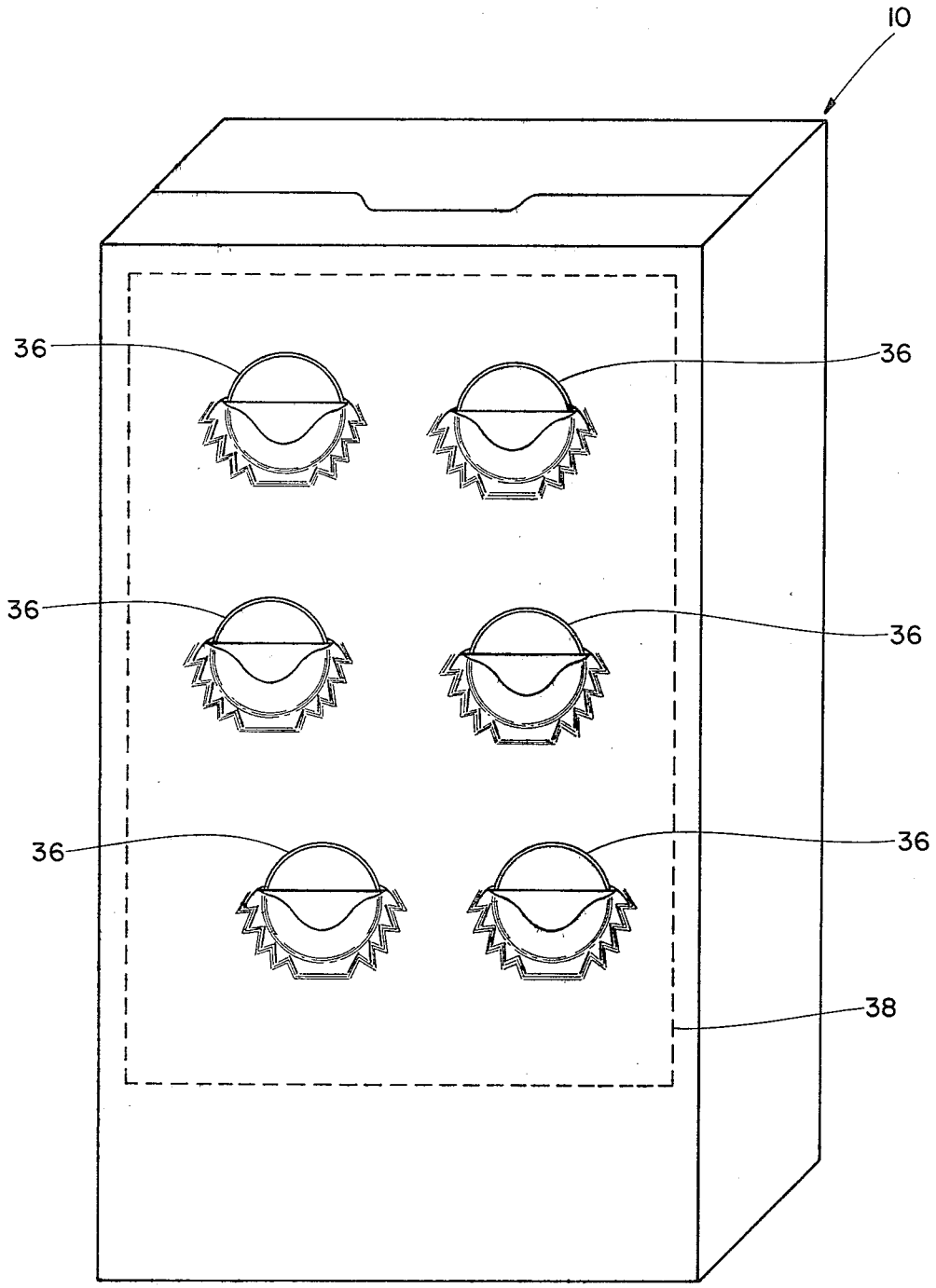
FIG. 4 is a rearward perspective view of a packaging carton constructed pursuant to the teachings of the present invention after expansion of each pocket and the placement therein of a generally circular medallion.

FIG. 4 illustrates the boxlike structure of FIG. 1, but with each pocket being expanded and having inserted therein a collectible medallion 36. FIG. 5 illustrates an enlarged view of one expanded pocket 12 having a suitable artifact inserted therein, and FIG. 6 is a sectional view taken along line 6—6 in FIG. 5 showing the position of the artifact in the expanded pocket.

Figure 7:
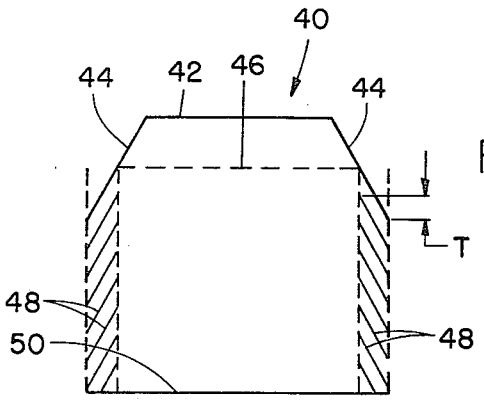
FIG. 7 illustrates a second embodiment of a perforation configuration designed to accommodate a rectangular or square object.

FIG. 7 illustrates a second embodiment 40 of a perforation configuration designed to accommodate a rectangular or square object. The perforation configuration includes a continuous slit 42 which joins angled end continuous slits 44, and in combination therewith forms a tear line extending across the top of the pocket and affording access to the pocket for deposit therein of a suitable object.

A linear discontinuous slit 46 is positioned parallel to and below the continuous slit 42, and in combination therewith forms a lift tab which may be grasped to open the pocket. A plurality of linear slits 48 are formed along the left and right peripheral edges of the pocket. The opposite ends of adjacent slits along each edge are separated by a distance T, as illustrated in FIG. 7, to define the maximum thickness (T) of an object which the pocket will accommodate. The slits 48 overlap a given distance in a predetermined pattern to accommodate a suitable inserted object, and a linear fold line 50 at the bottom of the pocket provides for its expansion upon insertion of an object therein.

Furthermore the slits providing for expansion of the pocket need not be linear, and is some embodiments may be curved.

The medal may have imprinted or embossed thereon indicia making it suitable for collection. For instance, difference types of medals may be offered in cereal boxes, with each medal having a different type of collectible image coined thereon. The cereal box may have pockets formed therein for the different types of collectible medals arranged in an array, with the name of each different type of medal adjacent each pocket. Other types of collectible medallions are possible within the teachings of the present patent application. Furthermore, the pockets need not be semicircular or rectangular, but may be designed in the shape of collectible items which are other than circular or rectangular in shape such as egg-shaped or triangular objects.

Additionally, the container may include a weakened portion, formed by discontinuous linear slits 38 cut the entire laminated structure, to provide for separation of a panel, having the collection of medallions therein, from the remainder of the box structure.

While a single embodiment of the present invention and several modifications thereof have been described in detail, it will be apparent to one of ordinary skill in the art that the disclosure herein will suggest many alternative and varied embodiments and arrangements within the context of the teachings of the present invention.

We claim:

1. A laminated structure of packaging material comprising an inner wall constituted of a relatively rigid material; an outer wall of relatively thin, generally pliant material; at least one perforation configuration comprising slits penetrating through said pliant outer wall material and arranged in a pattern defining at least one displaceable area constituting the outer wall panel of an object-receiving pocket intermediate said inner and outer walls; and a laminating adhesive interpsosed between said inner and outer walls for joining said walls to each other except in areas substantially coextensive with the area of said pocket to facilitate the insertion of an object into said pocket, said slits including a series thereof spaced apart in offset overlapping relation to one another along the peripheral edge of said panel and defining there-between a series of pliable strips interconnecting said panel with the surrounding area of said outer wall adhesively joined to said inner wall, said panel being displaceable outwardly from a flush to a spaced parallel relation with said inner wall by flexure of said strips in response to insertion of an object into said object-receiving pocket.

2. A laminated structure as claimed in claim 1, including an adhesive-repellent medium being provided intermediate the inner surface of said outer wall and said laminating adhesive in areas substantially coextensive with the areas of said at least one pocket.

3. A laminated structure as claimed in claim 2, said perforation configuration defining a substantially semicircular pocket and lift tab, said slits being arranged along the peripheral edge of said pocket and lift tab and comprising a first continuous slit extending between opposite portions of said semicircular pocket; a first plurality of discontinuous slits extending along the semicircular peripheral edge of said pocket from opposite ends of said continuous slit; and a second plurality of discontinuous slits extending linearly and traversely across said pocket intermediate opposite ends of said continuous slit to define a fold or tear line and affording access into said pocket for deposit therein of an object.

4. A laminated structure as claimed in claim 3, said first plurality of discontinuous slits extending along the semicircular peripheral edge of said pocket being linear slits extending between a plurality of imaginary concentric, radially inner and outer circles, and the slits being located at increasing spacings from each other proceeding from opposite ends of the continuous slit towards the bottom portion of said pocket.

5. A laminated structure as claimed in claim 3, said continuous slit comprising a plurality of tangentially joined, alternately concavely and convexly curved arcuate segments.

6. A laminated structure as claimed in claim 3, said outer wall-forming pliant material being yieldably deformable to facilitate insertion of an object into said pocket, said connecting strips along the semicircular peripheral edge of said pocket being foldable in response to the stresses generated in said pliant material so as to displace outwardly the outer pocket wall panel of said laminated structure upon insertion of an object into said pocket.

7. A laminated structure as claimed in claim 3, said pocket being shaped to receive a generally disc-like object.

8. A laminated structure as claimed in claim 3, said continuous slit extending outside the upper portion of said pocket, and said first plurality of discontinuous slits extending along the lower portion of said pocket.

9. A laminated structure as claimed in claim 1 or 3, said structure comprising a container having front, rear and side wall portions, and closure wall flaps at the ends thereof, said wall panels and flaps being formed of said laminated inner and outer wall construction, said inner wall comprising a relatively rigid paperboard, said at least one pocket being formed in the outer wall material of one of said container wall portions.

10. A laminated packaging structure as claimed in claim 9, including a plurality of said pockets being formed in said container wall portion, each said pocket being adapted to receive a disc-like object.

11. A laminated packaging structure as claimed in claim 10, said pockets being arranged in said container wall portion in a predetermined array, said wall portion having the array of pockets therein being adapted to be separated from said packaging structure so as to form a decorative display.

12. A laminated structure as claimed in claim 1 or 3, said structure forming a generally rectangular box-like container, said inner wall being paperboard and said outer wall being a glossy finish paper.

13. A laminated structure as claimed in claim 3, the portion of said outer wall defined by the first continuous slit and said second plurality of traversely extending discontinuous slits forming a gripping tab for opening said pocket to facilitate the insertion therein of an object.

14. A laminated structure as claimed in claim 2 or 3, said adhesive-repellent medium being located on the surface of said outer wall material facing said laminating adhesive.

15. A laminated structure comprising an inner wall constituted of a relatively rigid material; an outer wall of relatively thin, generally pliant material adapted to have indicia imprinted thereon; at least one perforation configuration comprising slits penetrating through said pliant outer wall material and arranged in a pattern defining the perimeter of at least one displaceable area constituting the outer wall panel of an object- receiving pocket intermediate said inner and outer walls; and a laminating adhesive interposed between said inner and outer walls for joining said walls to each other except in areas substantially coextensive with the areas of said pocket to facilitate the insertion of an object into each pocket, said slits including a series thereof spaced apart in offset overlapping relation to one another along the perimeter of said panel and defining therebetween a series of pliable strips interconnecting said panel with the surrounding area of said outer wall adhesively joined to said inner wall, said strips being deformable into folds to enable outward displacement of said panel and creation of said pocket while maintaining parallelism with said inner wall.

* * * * *